United States Patent [19]

Landaeus et al.

[11] Patent Number: 4,836,717

[45] Date of Patent: Jun. 6, 1989

[54] MEANS FOR JOINING CONCRETE PILES

[76] Inventors: Kjell Landaeus, Chemin des Meillières Est, Vence, France, F-06140; Bertil Borg, Kastberga 2, Eslöv, Sweden, S-241 00

[21] Appl. No.: 74,699

[22] PCT Filed: Oct. 28, 1986

[86] PCT No.: PCT/SE86/00492

§ 371 Date: Jun. 29, 1987

§ 102(e) Date: Jun. 29, 1987

[87] PCT Pub. No.: WO87/02726

PCT Pub. Date: May 7, 1987

[30] Foreign Application Priority Data

Oct. 28, 1985 [SE] Sweden ..... 8505068

[51] Int. Cl.[4] ..... E02D 5/10

[52] U.S. Cl. ..... 405/252; 403/294; 405/251

[58] Field of Search ..... 405/252, 251, 250, 232; 403/294, 295, 282, 335, 354

[56] References Cited

U.S. PATENT DOCUMENTS

| | | | |
|---|---|---|---|
| 2,378,562 | 6/1945 | Lahr | 403/294 X |
| 3,961,491 | 6/1976 | Reddaway et al. | 403/294 X |
| 4,050,211 | 9/1977 | Wahman | 403/294 X |
| 4,362,417 | 12/1982 | Vesa et al. | 405/251 X |
| 4,605,340 | 8/1986 | Stephan | 405/252 |

FOREIGN PATENT DOCUMENTS

| | | | |
|---|---|---|---|
| 683820 | 4/1964 | Canada | 405/252 |
| 48189 | 12/1933 | Denmark | 403/294 |
| 133415 | 1/1976 | Norway . | |
| 369936 | 9/1974 | Sweden . | |
| 405617 | 12/1978 | Sweden . | |
| 1360954 | 11/1972 | United Kingdom | 405/252 |
| 2089475 | 6/1982 | United Kingdom | 403/294 |
| 2115467 | 9/1983 | United Kingdom | 405/252 |

*Primary Examiner*—Dennis L. Taylor

*Attorney, Agent, or Firm*—Merchant, Gould, Smith, Edell, Welter & Schmidt

[57] ABSTRACT

Means for joining concrete piles (10) comprising a fixed end shoe (11) on each of the adjacent pile ends, and elements for joining the piles at the end shoes. Said elements include a number of guides (12) opening at the outside of the pile close to the adjacent pile ends, guides in one pile being located opposite to guides in the pile, and locking members (18), spanning the joint between the piles, which are driven from the outside into guides located opposite to each other in the pile ends to press said ends together by wedge action between guides and locking members. The guides (12) are dimensioned in relation to the locking members (18) so as to effect plastic stretching of the locking members after an initial displacement when the locking members are driven into the guides.

8 Claims, 3 Drawing Sheets

MEANS FOR JOINING CONCRETE PILES

The invention relates to means for joining concrete piles comprising a fixed end shoe on each of the adjacent pile ends, and elements for joining the piles at the end shoes, said elements including a number of guides opening at the outside of the pile, close to the adjacent pile ends, guides in one pile being located opposite to guides in the other pile, and locking members, spanning the joint between the piles, which are driven from the outside into guides located opposite to each other in the pile ends to press said ends together by wedge action between guides and locking members.

Joining means of this type is described in the Swedish patent application 7201610-0.

The advantage provided by joining means of the type referred to is that such means can be easily mounted and permits the end shoe to form a completely flat end surface. However, in the prior art embodiment, there is made no provision for maintaining positively in a satisfactory manner a permanent tight engagement between the adjacent pile ends without the risk of looseness arising in the joint between the piles due to vibrations and temperature changes.

The purpose of the invention is to construct the joining means in such a way that there can be provided and maintained a desired prestressing in the locking members, at the same time securing permanent engagement between the adjacent pile ends.

It is also intended to provide safe latching of the locking members in the prestressed condition in the guides.

For said purpose the joining means of the invention has obtained the characterizing features appearing from claim 1.

Figure 1:
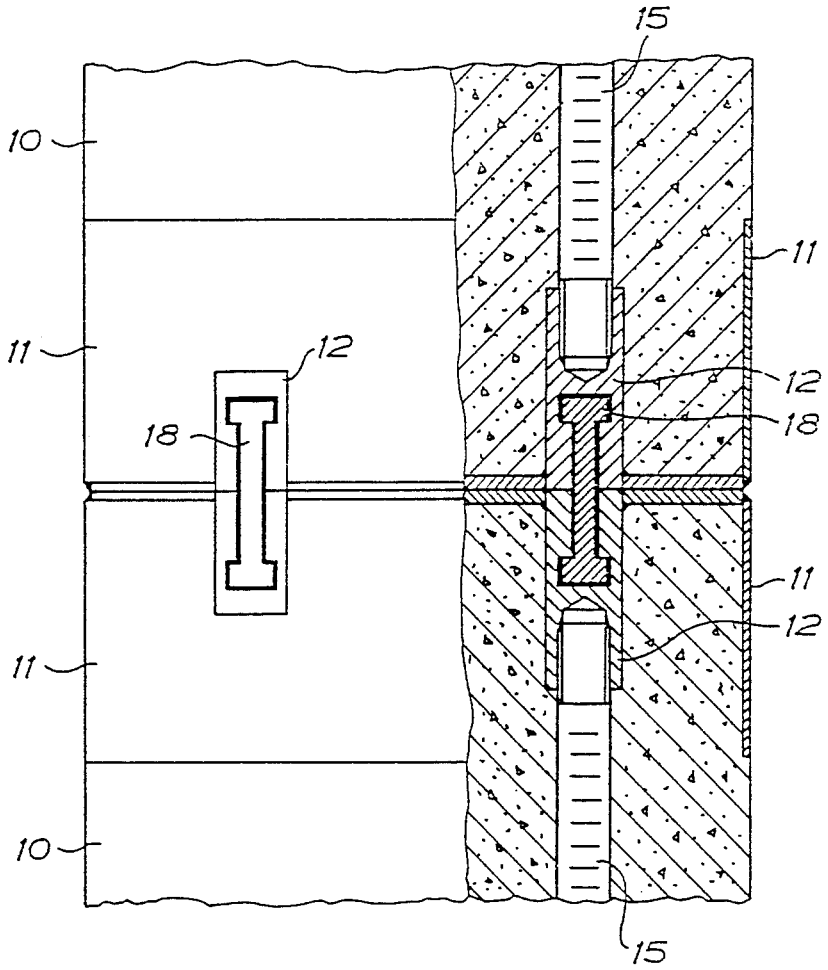
Figure 2:
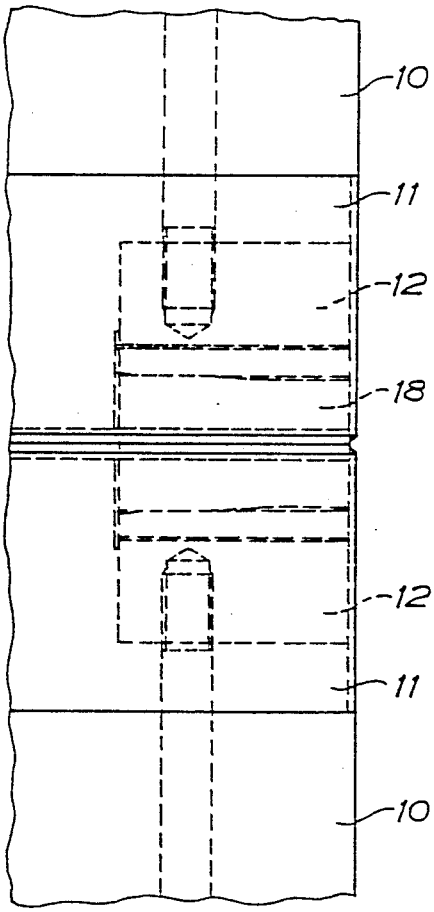
Figure 7:
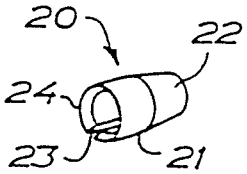
Figure 3:
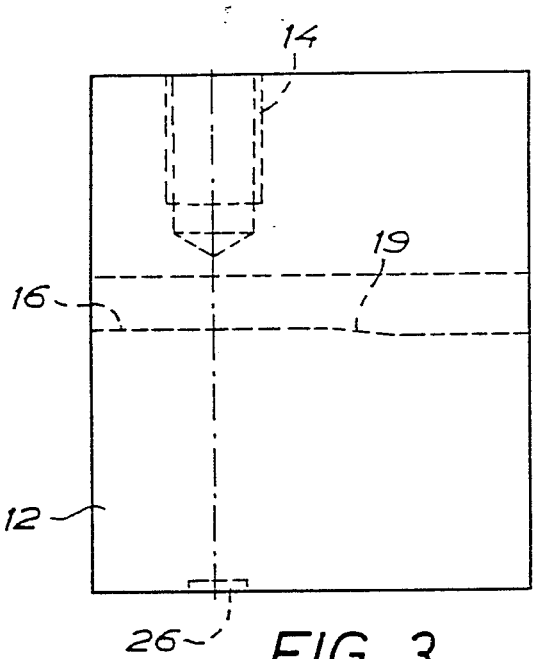
Figure 4:
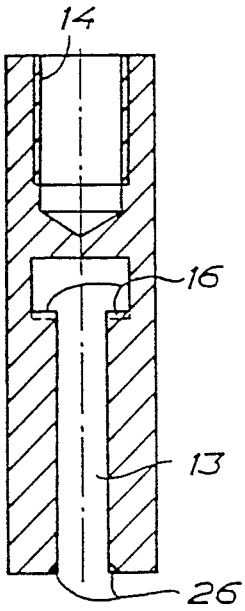
Figure 5:
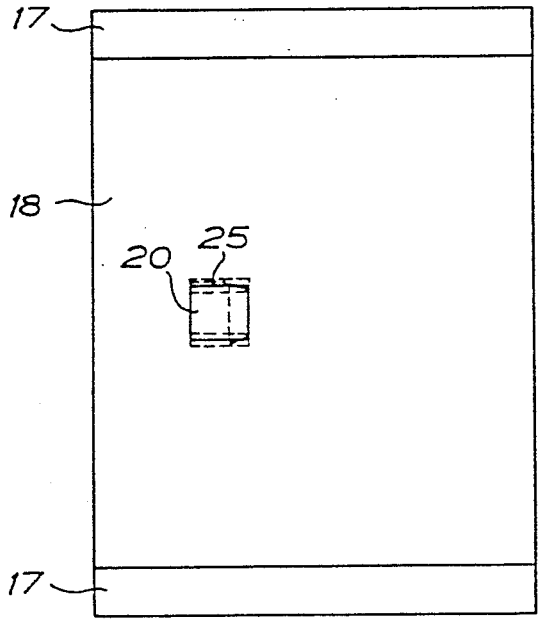
Figure 6:
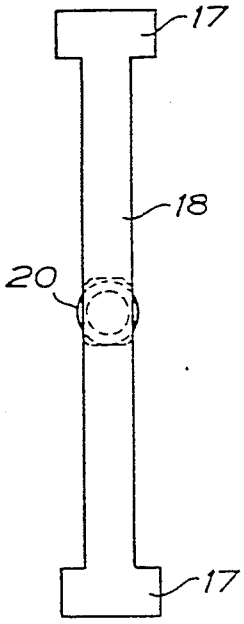

In order to explain the invention in more detail reference is made to the accompanying drawings which disclose one embodiment of the joining means of the invention and wherein FIG. 1 is a side view, partly a vertical sectional view, of the adjacent ends of two concrete piles joined by the joining means of the invention, FIG. 2 is a fragmentary side view of the pile ends taken perpendicularly to the view in FIG. 1, FIG. 3 is a side view of a guide in the joining means of the invention, FIG. 4 is a vertical sectional view of the guide in FIG. 3, FIG. 5 is a side view of a locking member in the joining means of the invention, FIG. 6 is an end view of the locking member shown in FIG. 5, and FIG. 7 is a perspective view of a latch member forming part of the joining means, to be located in the locking member for engagement into the guides co-operating with the locking member.

In FIGS. 1 and 2 in the drawings, the upper and lower ends, respectively, of two concrete piles 10 to be joined together are disclosed. As shown here, the piles have square cross-sectional shape, but as far as the invention is concerned they can have any cross-sectional form. Each pile has at the end thereof which is adjacent to the other pile, an end shoe 11 of metal sheet, which encloses the end portion of the concrete pile. This end shoe comprises a number of guides 12 attached by welding to the end shoe and moulded into the concrete pile. Each guide forms a T-shaped groove 13 which opens in the outside surface of the pile and extends perpendicularly to said surface into the pile. The guide is shown in more detail in FIGS. 3 and 4. It forms a threaded blind hole 14 for anchoring the guide to the pile by the end of a reinforcing iron 15 embedded into the pile, being screwed into the blind hole as shown in FIG. 1. Preferably, four guides are provided located in pairs at opposite sides of the pile, the guides in one pile end being opposite to the guides in the other pile end engaged therewith. The transverse portion of the T-shaped groove forms two abutment surfaces 16 for one flange 17 or the other of an I-shaped locking member 18 which is driven into two guides opposite to each other, to be received by one half in one guide and by one half in the other guide, spanning the joint between the two pile ends engaging each other.

In order to secure a satisfactory and permanent connection between the two pile ends the abutment surfaces 16 are spaced from the pile end such that the locking member rather easily can be driven into the guides substantially to the midpoint thereof where the abutment surfaces at an inclined surface 19 including an angle of the order of 5° join an inner portion spaced a greater distance from the end surface of the pile. This distance is so great that the locking member when passing onto the inner portion of the abutment surfaces during the continued driving, will be exposed to a stretching of the order of 5%, said stretching being substantially a plastic stretching, which implies, of course, that the locking member is made of a material allowing a great plastic stretching. By the plastic stretching any existing looseness between the pile ends facing each other will be eliminated. It should be noted that the blind hole 14 for the attachment of the reinforcing iron 15 is located substantially at the midpoint of that part of the abutment surfaces 16 in the guides 12, which is spaced the greater distance from the end surface of the pile, i.e. centrally of the portion of the locking member driven into the guides, which is exposed to plastic stretching. It is avoided by this arrangement that there will be produced in the pile a troublesome moment due to the pile ends being drawn together at the plastic stretching of the locking member.

An advantage of the interengagement of the pile ends effected by the locking member being plastically stretched is that the joining means can be manufactured without narrow tolerances being applied, because existing inaccuracies will be compensated for when using the joining means.

In order to latch reliably the locking member 18 when it is driven into the guides 12 there is provided a latch member 20, FIG. 7. This latch member comprises a steel sleeve having a cylindrical portion 21 and a conical portion 22, and said sleeve is slotted in the longitudinal direction thereof so that it can be resiliently compressed; the slot is shown at 23. The cylindrical portion 21 forms a sharp edge 24. The latch member is received in a rectangular recess 25 in the locking member, FIG. 5, the cylindrical portion of the latch member having such diameter that said portion projects slightly at the sides of the locking member, as will be seen from FIG. 6. The recess 25 is located at the midpoint vertically of the locking member closer to one end of said member than the other end thereof, viz. closer to the end intended to face outwards when the locking member is in the operative position thereof. Thus, the latch member will be disposed centrally of the interface between the two adjacent pile ends when the locking member is being driven. When this is effected, the latch member will be compressed elastically, which is permitted by the slot 23, because the latch member is wider than the groove in the guide. Furthermore, the latch member will engage into the bounding surfaces of the groove at the sharp edge 24 if the locking member tends to move outwards from the groove in the guides, such movement of the locking member being effectively prevented thereby. For a still more effective latching a small chamfer as long as the latch member can be provided in the groove of each guide at the opening of the groove in the end surface of the pile as is shown at 26 in FIGS. 3 and 4 such that the latch member can expand under spring bias at this chamfer just as the locking member has been completely driven into the groove. Then, the latch member will engage the edges of the chamfer if the locking member tends to move out of the groove, which provides a particularly effective latching of the locking member against such movement.

Instead of providing a central latch member in each locking member there can be provided two such latch members for engagement each with one of the two guides co-operating with the locking member.

It is possible to shape the locking member in another way than that shown herein in connection with the illustrative embodiment described. This member can be formed as a bow the limbs of which are connected with a pin and which is driven into the guides by hammering on the web. Thus, the pin will be received in the groove and accordingly will form the part that is exposed to the plastic stretching. Alternatively,the bow can be dispensed with and the pin can be provided with a central cross-head which projects from the pin so as to form the part on which one is hammering when driving the locking member.

In order to centre the pile ends when engaging said ends with each other a central pin can be provided in a known manner in one pile end to engage a central hole in the other pile end when the pile ends are moved together.

We claim:

1. An arrangement for joining together two concrete piles in end-to-end relationship; said arrangement comprising:

(a) first and second end shoes one each of which is fixed to each pile to be joined together at adjacent ends thereof;

(b) a plurality of guide elements at least one each of which is attached to each end shoe; said guide elements defining guide passages extending transversely of an associated pile; said guide passages each having an opening at an outside of the associated pile;

(i) each guide element attached to said first shoe being operatively positioned in opposing relationship to a guide element attached to said second shoe, two opposed guide elements defining a set of opposed guide elements, each set of opposing guide elements defining a key member-receiving passageway comprising opposing guide passages;

(ii) said guide elements having first abutment surfaces therein adjacent an associated guide passageway opening; and, said guide elements having second abutment surfaces therein positioned inwardly along said guide passages from said first abutment surfaces;

(iii) a distance between the first abutment surfaces of two opposite guide elements of a set of opposed guide elements, in a longitudinal direction of the piles, being shorter than a distance between second abutment surfaces of said guide elements of said set of opposed guide elements;

(c) a key member operably receivable in each key member-receiving passageway and sized to span a joint between the adjacent piles;

(i) said key member having opposite abutment surfaces oriented for respective engagement with said first and second abutment surfaces of said guide elements, when said key element is received with said key-receiving passageway;

(ii) said distance between said first abutment surfaces and said distance between said second abutment surfaces being dimensioned in relation to a distance between said key member opposite abutment surfaces so as to provide for plastic stretching of said key member as same is driven into said key receiving passageway from association with said first abutment surfaces into engagement with said second abutment surfaces.

2. An arrangement according to claim 1 including:

(a) joining means for engaging each guide element with at least one reinforcing iron in an associated pile.

3. An arrangement according to claim 2 wherein:

(a) said joining means includes a connector arrangement oriented for providing engagement between a guide element and a reinforcing iron at a point of engagement oriented substantially centrally along a longitudinal extension of a second abutment of said guide element.

4. An arrangement according to claim 1 wherein:

(a) said guide elements each include a sloping transition portion provided between associated first and second abutment surfaces.

5. An arrangement according to claim 1 wherein:

(a) said guide elements each define a guide passage having a T-groove configuration; and, (b) said key member has an I-shaped crosssection.

6. An arrangement according to claim 5 including:

(a) a latch member associated with said key member and including means for engagement with an associated guide element to inhibit movement of the key member outwardly from the guide element.

7. An arrangement according to claim 6 wherein:

(a) said latch member comprises a resiliently compressible slotted sleeve member having a diameter greater than a width of an associated portion of said key-receiving passageway;

(i) said sleeve member including a sharp edge portion engageable with a portion of an associated guide member during attempted movement of said key member outwardly of said key-receiving passageway.

8. An arrangement according to claim 7 wherein:

(a) said guide member, defining said key-receiving passageway, also defines a recess for receiving said latch member therein, when the key member is operably inserted in said key-receiving passageway.

* * * * *